US010665214B2

(12) United States Patent
Bedore et al.

(10) Patent No.: US 10,665,214 B2
(45) Date of Patent: May 26, 2020

(54) INSTRUMENT CASE WITH STAND AND/OR MAINTENANCE STATION

(71) Applicant: James Quinn Bedore, Ithaca, NY (US)

(72) Inventors: James Quinn Bedore, Ithaca, NY (US); Galen P. Marteal, Ithaca, NY (US)

(73) Assignee: James Quinn Bedore, Ithaca, NY (US)

( * ) Notice: Subject to any disclaimer, the term of this patent is extended or adjusted under 35 U.S.C. 154(b) by 0 days.

(21) Appl. No.: 16/220,707

(22) Filed: Dec. 14, 2018

(65) Prior Publication Data

US 2019/0189099 A1 Jun. 20, 2019

Related U.S. Application Data

(60) Provisional application No. 62/598,524, filed on Dec. 14, 2017.

(51) Int. Cl.

| | |
|---|---|
| ***G10G 7/00*** | (2006.01) |
| ***G10D 1/08*** | (2006.01) |
| ***G10H 3/18*** | (2006.01) |
| ***G10G 5/00*** | (2006.01) |

(52) U.S. Cl.

CPC ..... *G10G 7/005* (2013.01); *G10D 1/08* (2013.01); *G10G 5/00* (2013.01); *G10H 3/18* (2013.01)

(58) Field of Classification Search

CPC ..... A45C 13/00; A45C 13/005; A45C 13/02; A45C 13/26; B65D 21/02; B65D 21/0204; F16M 11/38; G10D 1/08; G10G 5/00; G10G 7/00; G10G 7/005; G10H 3/18

USPC ..... 206/314

See application file for complete search history.

(56) References Cited

U.S. PATENT DOCUMENTS

| | | | | |
|---|---|---|---|---|
| 5,833,051 | A | 11/1998 | Tiefenbrun et al. | |
| 6,296,213 | B1 | 10/2001 | Law, III et al. | |
| 6,462,260 | B2 | 10/2002 | Fediakov | |
| 8,759,654 | B2 | 6/2014 | Nakata et al. | |
| 2012/0074270 | A1 | 3/2012 | Pays | |
| 2015/0310842 | A1 * | 10/2015 | Coburn | G10G 7/005 206/314 |

FOREIGN PATENT DOCUMENTS

FR 3057695 A1 4/2018

OTHER PUBLICATIONS

"Road Runner RRGS6 6 Guitar Stand Case Black Tolex", retrieved from https://www.guitarcenter.com/Road-Runner/RRGS6-6-Guitar-Stand-Case.gc; as early as Sep. 2015.

* cited by examiner

*Primary Examiner* — Byron P Gehman
(74) *Attorney, Agent, or Firm* — Brown & Michaels, PC

(57) ABSTRACT

An instrument case with one or more rack instrument stands with or without an instrument maintenance station combined into a hard-shell instrument transport case. The one or more rack instrument stands are attached to the inner top lid of the instrument case and has a comb shaped structure which can be locked into place when in use. The one or more rack instrument stands can store one or more different types of instruments at the same time when the case is open.

20 Claims, 17 Drawing Sheets

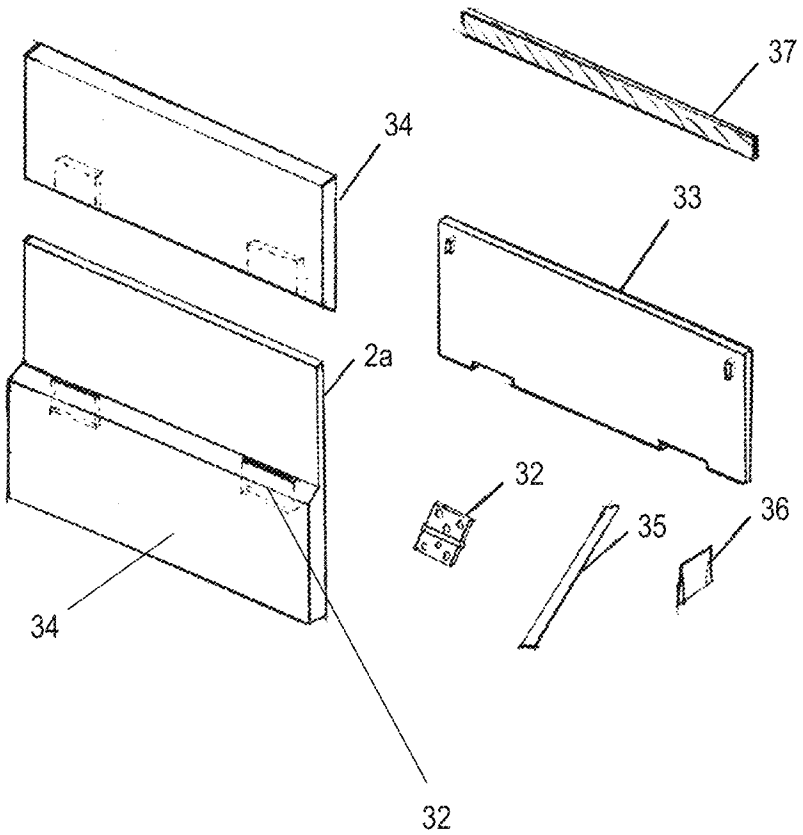
Fig. 12
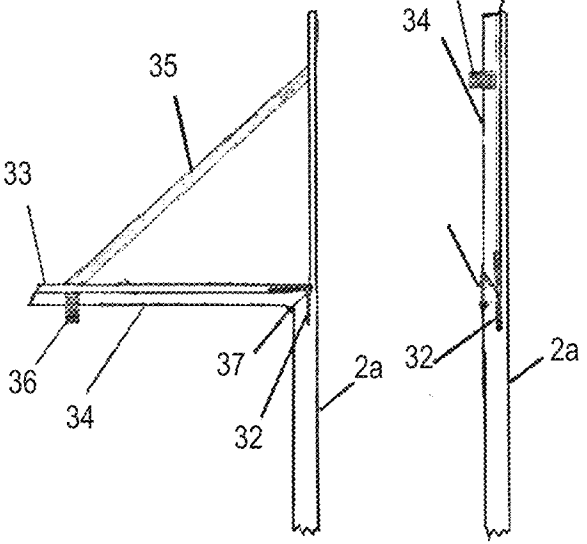
Fig. 11b
Fig. 11a

INSTRUMENT CASE WITH STAND AND/OR MAINTENANCE STATION

REFERENCE TO RELATED APPLICATIONS

This application claims one or more inventions which were disclosed in Provisional Application No. 62/598,524, filed Dec. 14, 2017, entitled "Instrument Case with Stand and/or Maintenance Station". The benefit under 35 USC § 119(e) of the United States provisional application is hereby claimed, and the aforementioned application is hereby incorporated herein by reference.

BACKGROUND OF THE INVENTION

Field of the Invention

The invention pertains to the field of instrument cases. More particularly, the invention pertains to an instrument case with a stand and/or maintenance station.

Description of Related Art

Many musicians have very little space and a lot of equipment to transport and store. Equipment is cumbersome and bulky and car space is limited, so many musicians do not bring maintenance stations and guitar stands to shows. Instead, musicians bring just their instrument cases to protect the instruments during transit, resulting in their not having a place to stand or fix the instruments when they arrive at the show.

SUMMARY OF THE INVENTION

In an embodiment of the present invention an instrument case integrates a rack instrument stand and a guitar maintenance station into a hard-shell guitar/electric bass case. The instrument case provides musicians with a lightweight and compact solution to their problem of transporting and storing important, yet often neglected music equipment such as guitar stands and maintenance stations. The case utilizes conventionally wasted space to provide safety for instruments both on the road and at shows, while including a maintenance station to fix instruments in any situation.

The instrument case of an embodiment of the present invention utilizes the wasted space in most guitar/electric bass cases to protect instruments not only in transit, but at shows. This extra protection is possible by using a rack instrument stand that folds out of the case, allowing for the storing of at least three instruments including an enlarged space or spaces for acoustic instruments. The case allows not only for protection of instruments, but includes a fold out maintenance station with a shelf to maintain and fix instruments on the go.

BRIEF DESCRIPTION OF THE DRAWING

FIG. 11*a* shows a side view of the shelf in an open position.

FIG. 11*b* shows a side view of the shelf in a closed position.

FIG. 12 shows components of the shelf.

DETAILED DESCRIPTION OF THE INVENTION

FIGS. 1-18 show an embodiment of an instrument case of an embodiment which incorporates a rack instrument stand, a maintenance station into an instrument transport case.

Figure 18:
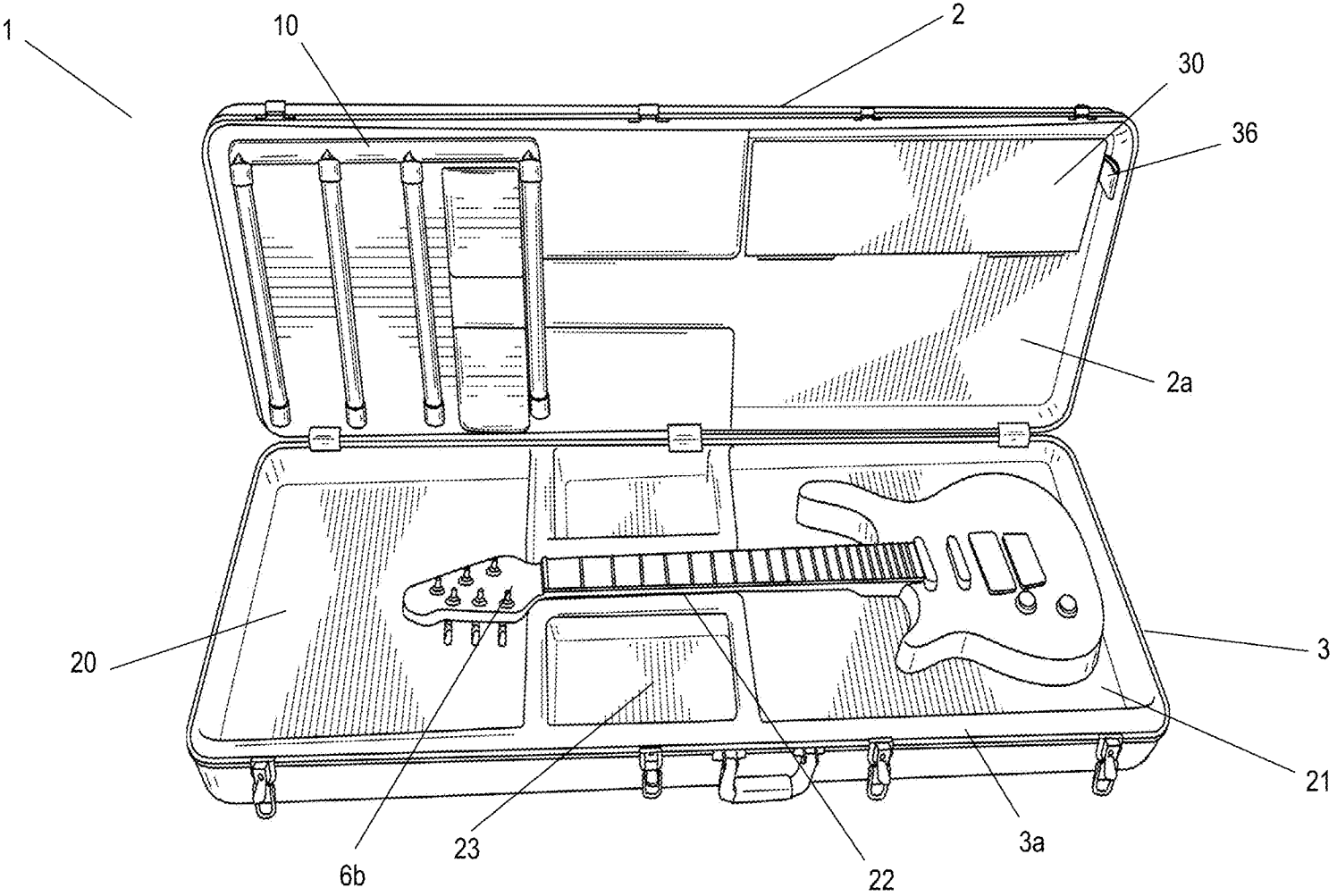
FIG. 18 shows the instrument case of an embodiment of the present invention in an open position with a bass in the case for transport.

The instrument case 1 includes a top lid 2 and a bottom lid 3. The top lid 2 and the bottom lid 3 of the instrument case 1 each include a padding insert 2*a*, 3*a*, for example of foam or other cushioning material, surrounded by an outer shell 2*b*, 3*b*. The outer shell is preferably hard. The foam padding insert 2*a*, 3*a* may include a fabric covering to provide additional protection to the instrument housed within the instrument case 1. The top lid 2 is rotatably connected to the bottom lid 3 through a series of a hinges 4 or other connectors to allow the top lid 2 to rotate through positions from at least an open position that is at least 90 degrees relative to the bottom lid 3 to a closed position with the top lid 2 closed against the bottom lid 3. When the instrument case 1 is in a closed position and the top lid 2 is secured to the bottom lid 3, the instrument case 1 can be used to transport an instrument, with the top and bottom lids 2, 3 surrounding the instrument within the instrument case between the foam padding inserts 2*a*, 3*a*. FIG. 18 shows the case in an open position with an instrument ready for transport. It should be noted that the hinges 4 can additionally prevent rotation past 90 degrees with an integral stop.

An additional lock or mechanism 5 can be present connecting the top lid 2 to the bottom lid 3 and locking the top lid 2 in a position of 90 degrees relative to the bottom lid 3. It should be noted that in an embodiment of the present invention, the top lid 2 can be locked into other positions relative to the bottom lid 3 that are less than 90 degrees. The lock mechanism can additionally be incorporated into the hinges 4.

The top lid 2 includes padding insert 2*a* to protect an instrument 6 during transport within the instrument case 1. Additionally, the top lid 2 includes a rack instrument stand 10 that is moveable between an extended position and a retracted position. In the extended position as shown in FIGS. 1, 6, 7, and 17, the rack instrument stand 10 is parallel to the bottom lid 3 and is perpendicular to the top lid 2. In the retracted position, the rack instrument stand 10 is received within the padding insert 2*a* of the top lid 2 and preferably does not contact an instrument 6 which is placed in the bottom lid 3 when the instrument case 1 is closed for transport of the instrument. The top lid 2 additionally includes a fold-out storage shelf 30 described in further detail below. While not shown, additional foldout shelves or compartments can be present in the top lid 2 of the instrument case 1.

The bottom lid 3 of the instrument case 1 includes a padding insert 3*a* which includes a first recessed padded area 20, a second recessed padded area 21 with a moveable neck stand 40, and a padded neck support 22 between the first and second recessed padded areas 20, 21. The padded neck support 22 can additionally include compartments 23 for storage.

When the top lid 2 is rotated about the hinges 4 to an open position 90 degrees relative to the bottom lid 3, the rack instrument stand 10 of the top lid 2 is aligned with the first recessed padded area 20 and the fold-out storage shelf 30 is aligned with the second recessed padded area 21.

Referring to FIGS. 1-8 and 17-18, the rack instrument stand 10 has a framework 11 which is essentially comb shaped. The rack instrument stand 10 has a hollow back framework piece 12 with a first end extension piece 13, a second end extension piece 14 and at least one middle extension piece 15*a*, 15*b* spaced a distance D1, D2 from the end extension pieces 13, 14 and any other middle extension pieces 15*a*, 15*b*. The number of middle extension pieces can vary, thus varying the number of instruments to be stored in the rack guitar stand at one time. In one embodiment, the number of middle extension pieces would be seven and would allow up to eight instruments to be stored in the rack guitar stand. The number of middle extension pieces needed is one less than the number of instruments to be stored in the rack guitar stand at one time. In other embodiments, three middle extension pieces can be present to store four instruments, four middle extension pieces can be present to store five instruments, five middle extension pieces can be present to store six instruments, and six middle extension pieces can be present to store seven instruments.

The distance D1, D2 can vary to accommodate different sized instruments. For example, a greater distance D2 is needed to accommodate a body 62 width of an acoustic guitar 6*a* relative to the body 62 width of an electric guitar 6*b* or bass guitar 6*c*. The back framework piece 12 is secured by clamps or swivels 17 to the top lid 2 of the instrument case 1, rotatable between the retracted position and the extended position.

Figure 25:
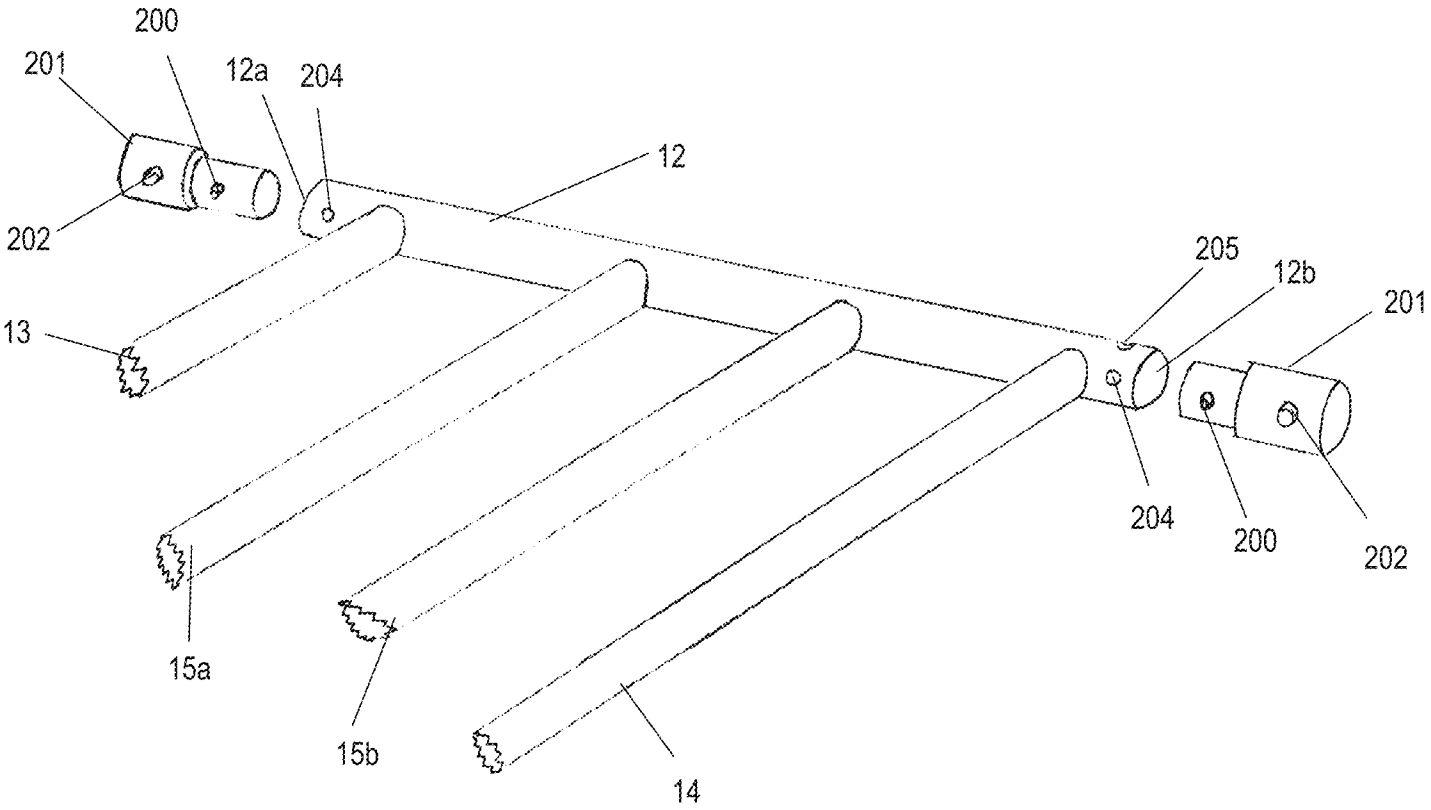
FIG. 25 shows an alternate embodiment of securing the back framework piece to the top lid of the instrument case.

Other means for rotatably securing the back framework piece 12 may be used besides clamps. For example, as shown in FIG. 25, retaining pins 200 may be present on end caps 201 which are received within a hollow portion 53 on each side of the back framework piece 12. A first end 12*a* of the back framework piece 12 can have a first hole 204 and the second end 12*b* of the back framework piece 12 can a first hole 204 and a second hole 205. Holes 204 on either end of the back framework piece 12 are aligned, The second hole 205 may be placed at least 90 degrees from the first hole 204. Other spacings between the first hole 204 and second hole 205 may also be used.

Retaining pins 200 may be spring biased and may be received or lock into place within holes 204, 205 of the back framework piece 12. To unlock the retaining pins, a user can press the retaining pin 200 protruding from the hole and rotate the back framework piece 12 similar to the locking mechanism described below. The first hole 204 and the second hole 205 on the back framework piece 12 may be used to lock the back framework piece in two positions which are 90 degrees apart (e.g. recessed position and extracted position), although other positions may also be used depending on the placement of the holes. Additional pins 202 within the end caps 201 may be used to secure the end caps and thus the back framework piece 12 to the top lid 2.

In another embodiment, the first end 12*a* and the second end 12*b* of the back framework piece 12 each have the first hole 204 and the second hole 205. In yet another embodiment, both the first end 12*a* and the second end 12*b* of the back framework piece 12 each have a single hole, either hole 204 or 205 and lock the back framework piece 12 into a single position.

In another example, a shaft can be secured to the top lid 2 and received within a hollow portion 53 of the back framework piece 12, allowing the back framework piece 12 to rotate about the axis of the shaft. The shaft can extend the entire length of the back framework piece 12.

In yet another example, an additional tube may be present on the outer circumference of the back framework piece 12 and secured to the top lid 2. The back framework piece 12 is received within the additional tube and rotates within the additional tube.

In another example, the first end 12*a* can have only first hole 204 and the second end 12*b* of the back framework piece 12 can only have a second hole 205 offset from the first hole by at least 90 degrees, allowing the back framework piece 12 to be locked into two positions.

In the extended position, the extension pieces 13, 14, 15*a*, 15*b* extend and are parallel to the first recessed padded area 20 of the bottom lid 3 of the instrument case 1. In one embodiment, the first recessed padded area 20 includes detachable padded spacers 24 to aid in separating and maintaining the instruments between the extension pieces 13, 14, 15*a*, 15*b* of the rack instrument stand 10. It should be noted that the configuration of the spacers 24 is not limited to the configuration shown in the drawings. During transport of the instrument with the instrument case in a closed position, the spacers 24 can be removed from the first recessed padded 20 area and stored elsewhere within the instrument case 1.

The back framework piece 12 of the rack instrument stand 10 can include a locking mechanism 50, which secures the back framework piece 12 into at least the extended position. The placement and the number of locking mechanisms 50 can vary depending on how the back framework piece 12 is secured to the top lid 2. In the embodiment in which retaining pins are present on each side of the back framework piece 12 and secured to the top lid 2, the locking mechanism would be present on the sides with the retaining pins. In the embodiment in which a shaft is secured to the top lid 2 and received within a hollow portion 53 of the back framework piece 12, the locking mechanism is present on the side of the back framework piece 12 or locating centrally along the back framework piece 12. In the embodiment in which includes one or more additional tubes, a locking mechanism would be present on one or more of the tubes.

Each of the extension pieces 13, 14, 15*a*, 15*b* of the rack instrument stand 10 can include padding or cushioning to aid preventing any damage occurring to the necks 61 or the body 62 of the instruments 6*a*-6*c* when placed in the rack instrument stand 10.

An example of a locking mechanism 50 is shown in FIGS. 2-5. The locking mechanism 50 includes a metal spring clip 51 with a push button 51*a*, a pivot sleeve 52, and a hollow portion 53 of the back framework piece 12. The spring clip 51 is inserted into a hollow portion 53 of the back framework piece 12, such that the push button 51*a* extends out from a hole 12*b* in the back framework piece 12 and is aligned with the hollow portion 53. A pivot sleeve 52 with a hole 55 is fitted over the outer circumference of the back framework piece 12. When the back framework piece 12 is rotated relative to the pivot sleeve 52 such that the hole 55 of the pivot sleeve 52 and the hole 12*b* of the back framework piece 12 are aligned, the push button 51*a* of the spring clip 51 is biased outwards and prevents further rotation, thus locking the back framework piece 12 into position. To unlock or move the rack instrument stand 10 to a retracted position, the push button 51*a* is depressed or pushed inwards from the hole 55 of the pivot sleeve 52 and the back framework piece 12 can be rotated relative to the pivot sleeve 52. While one locking mechanism 50 is shown, additional locking mechanisms may be associated with the rack instrument stand 10.

In an alternate embodiment as shown in FIGS. 21-24, the pivot sleeve 152 can include two holes 155, 156 spaced 90 degrees apart on the outer circumference, allowing the push button 51*a* to lock the position of the rack instrument stand 10 in the both the extended and recessed position.

The locking mechanism 150 includes a metal spring clip 51 with a push button 51*a*, a pivot sleeve 152, and a hollow portion 53 of the back framework piece 12. The spring clip 51 is inserted into a hollow portion 53 of the back framework piece 12, such that the push button 51*a* can extends out from a hole 12*b* in the back framework piece 12 and is aligned with the hollow portion 53. A pivot sleeve 52 with a first hole 155 and a second hole 156 spaced 90 degrees apart along the outer circumference is surrounds the outer circumference of the back framework piece 12. When the back framework piece 12 is rotated relative to the pivot sleeve 152 such that the first hole 155 of the pivot sleeve 52 and the hole 12*b* of the back framework piece 12 are aligned, the push button 51*a* of the spring clip 51 is biased outwards and prevents further rotation, thus locking the back framework piece 12 into position, for example the recessed position. To unlock or move the rack instrument stand 10, the push button 51*a* is depressed or pushed inwards from the first hole 155 of the pivot sleeve 152 and the back framework piece 12 can be rotated relative to the pivot sleeve 152. The pivot sleeve 152 has an additional hole 156 in which the push button 51*a* can receive and locks the movement of the back framework piece 12. Therefore, the locking mechanism can lock the back framework piece in both the recessed position and the extended position.

While one locking mechanism 50 is shown, additional locking mechanisms may be associated with the rack instrument stand 10. For example, the rack instrument stand 10 can include one or more lock mechanisms 50 with a single hole 55 on the pivot sleeve 52 and a one or more lock mechanism 150 with dual holes 156, 155 on the pivot sleeve 152.

Figure 1:
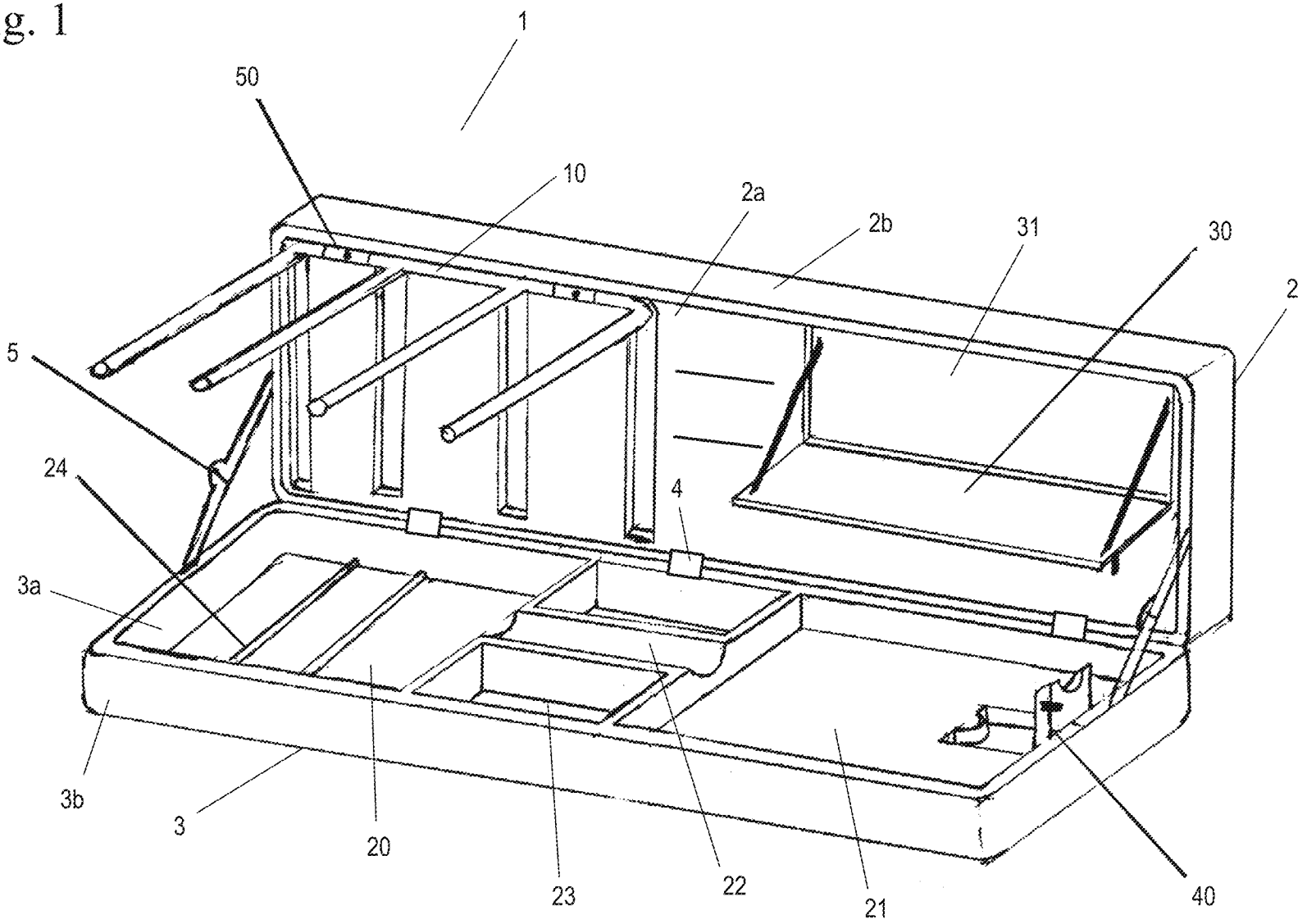
FIG. 1 shows an instrument case of an embodiment of the present invention in an open position.
Figure 3:
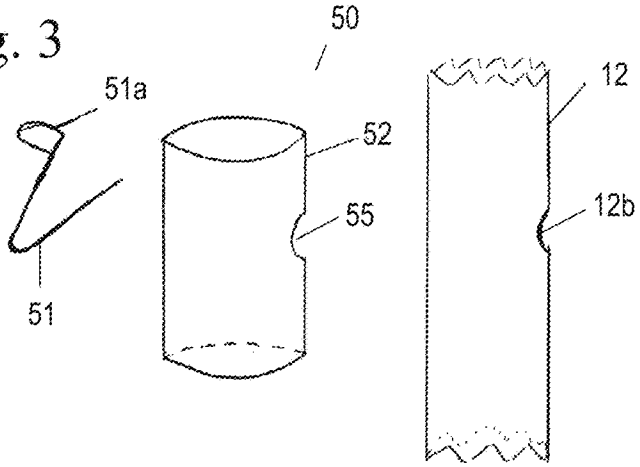
FIG. 3 shows components of the locking mechanism of FIG. 2.
Figure 5:
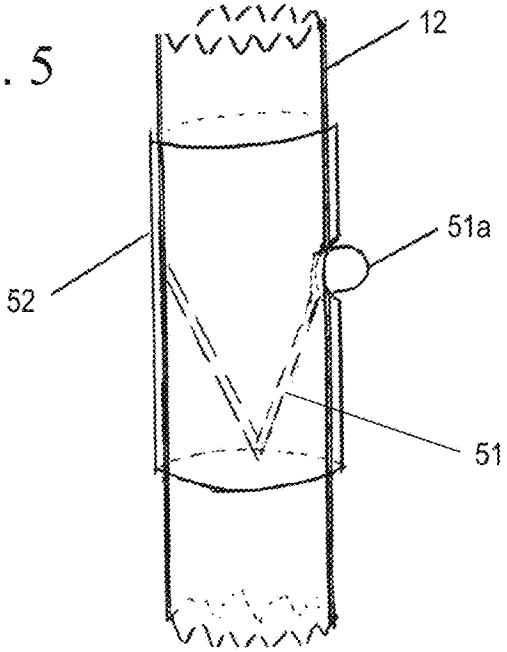
FIG. 5 shows another view of the locking mechanism of FIG. 2.
Figure 2:
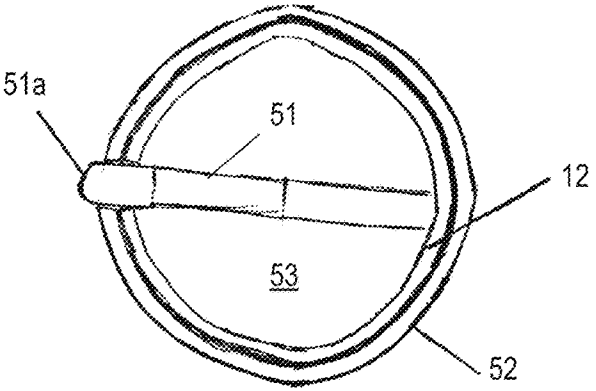
FIG. 2 shows a cut-through view of an example of a locking mechanism to lock a guitar stand in an extended position.
Figure 4:
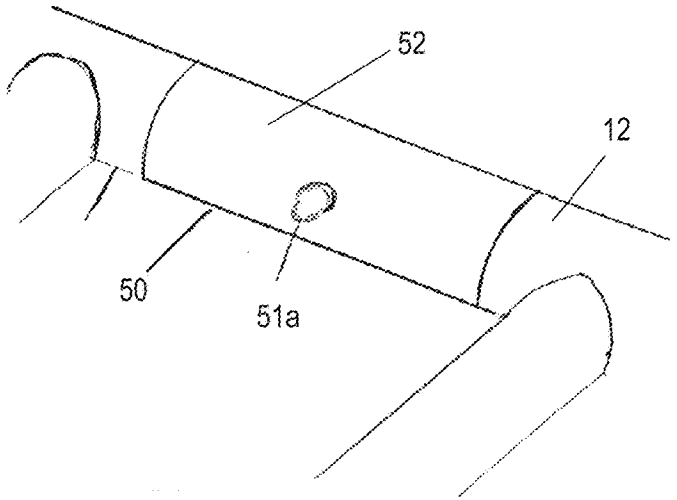
FIG. 4 shows a close-up of the locking mechanism of FIG. 2.
Figure 6:
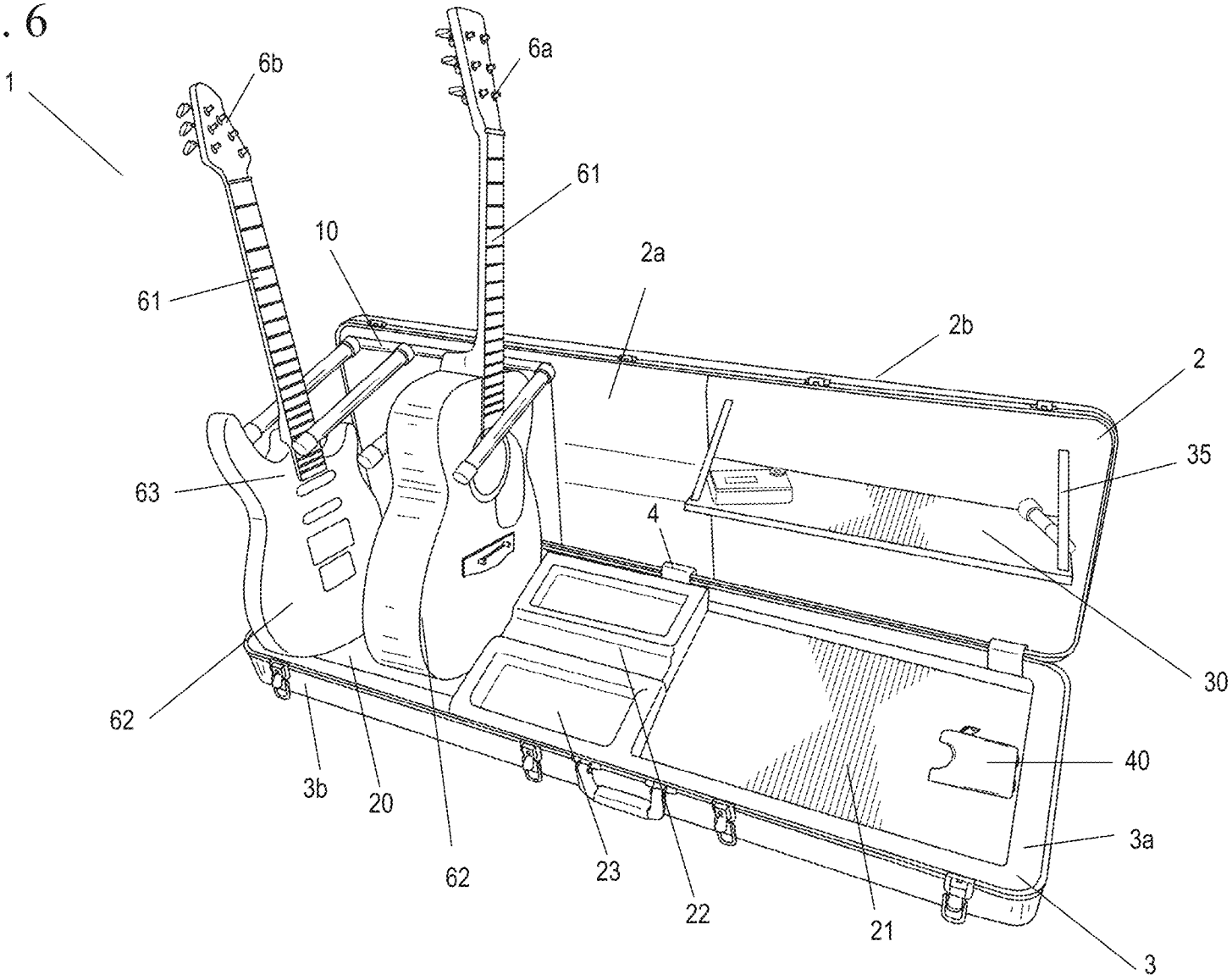
FIG. 6 shows the instrument case of an embodiment of the present invention in an open position with two guitars in a standing position.
Figure 7:
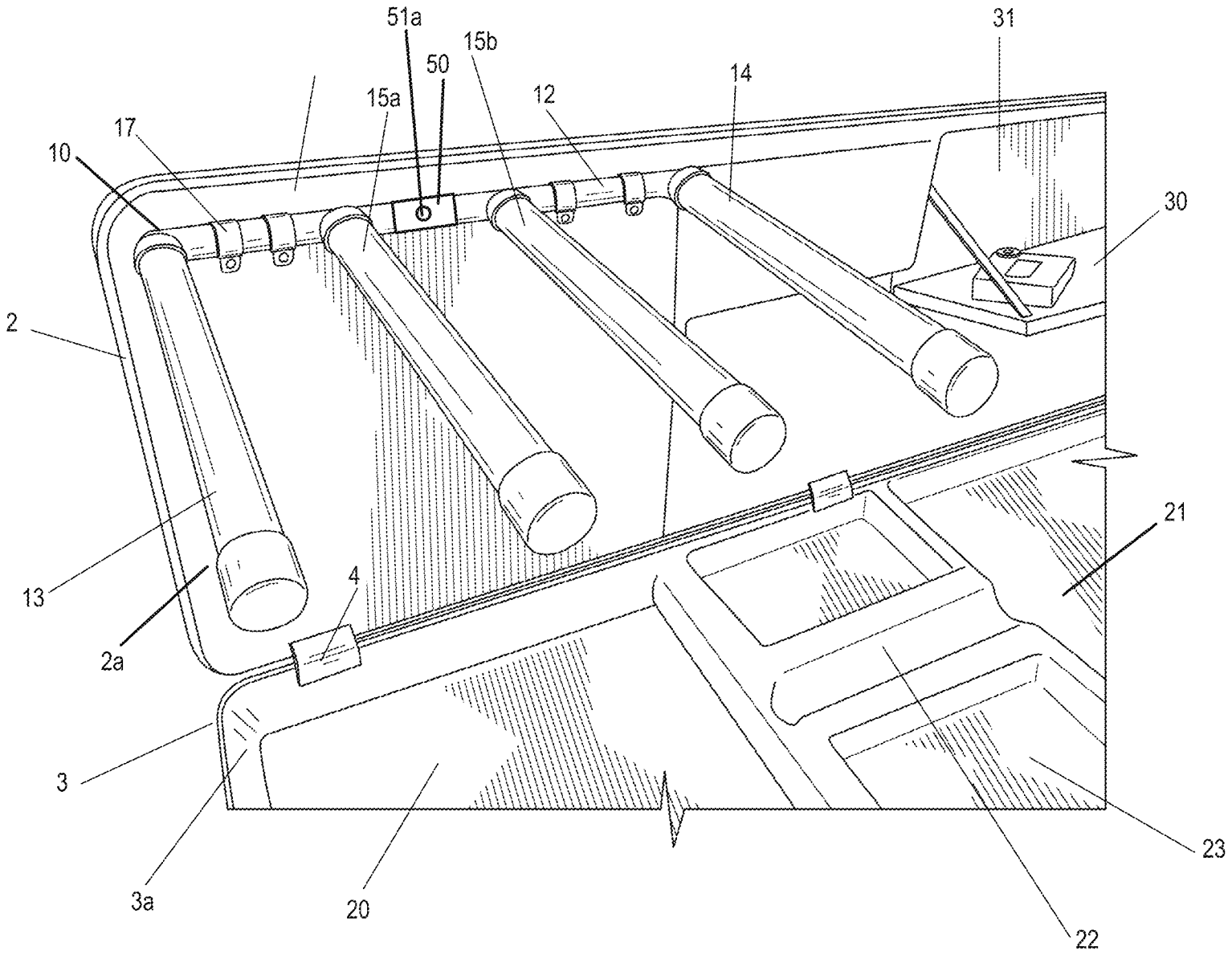
FIG. 7 shows a close up of the guitar stand in an extended position.
Figure 8:
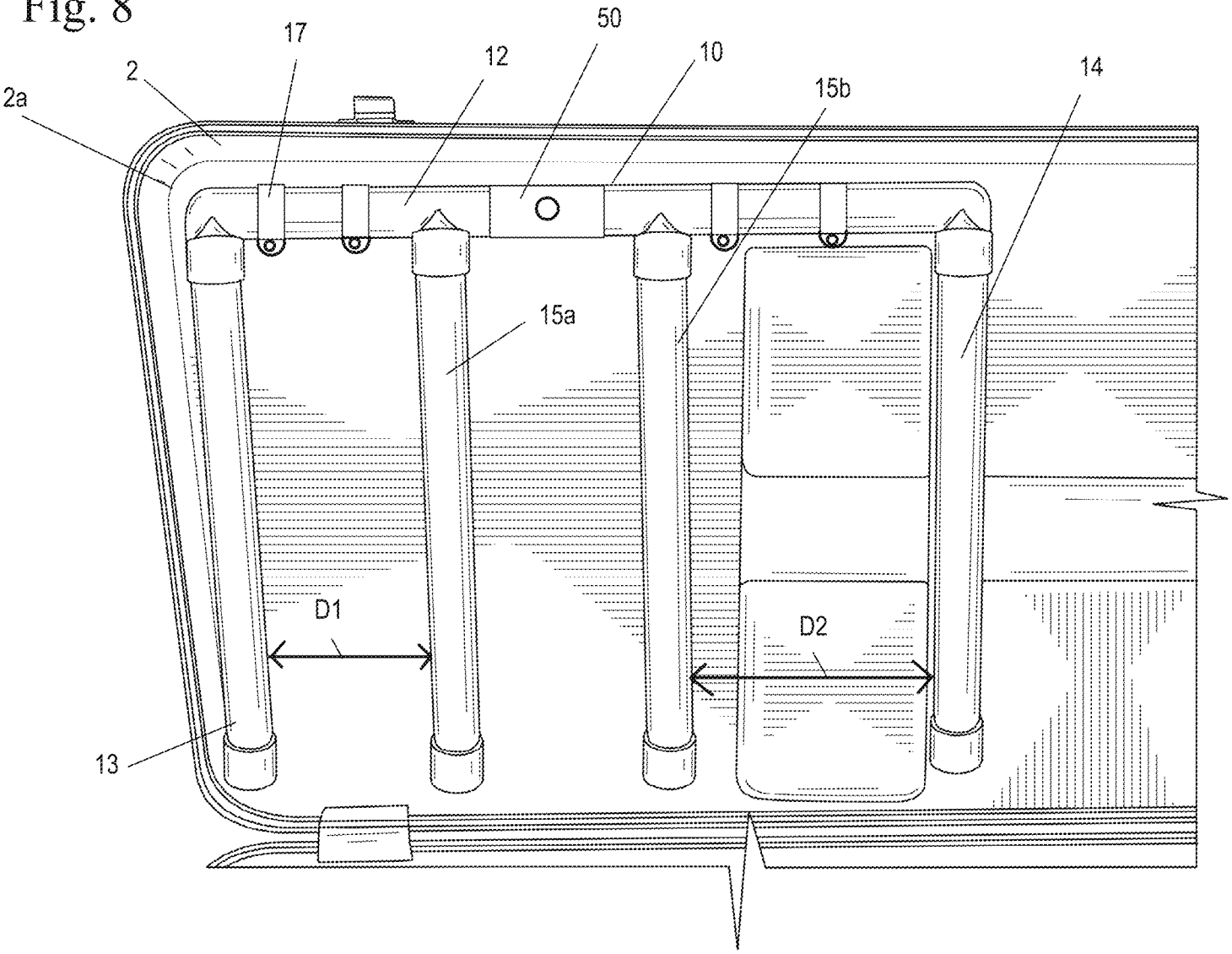
FIG. 8 shows a close up of the guitar stand in a retracted position.
Figure 9:
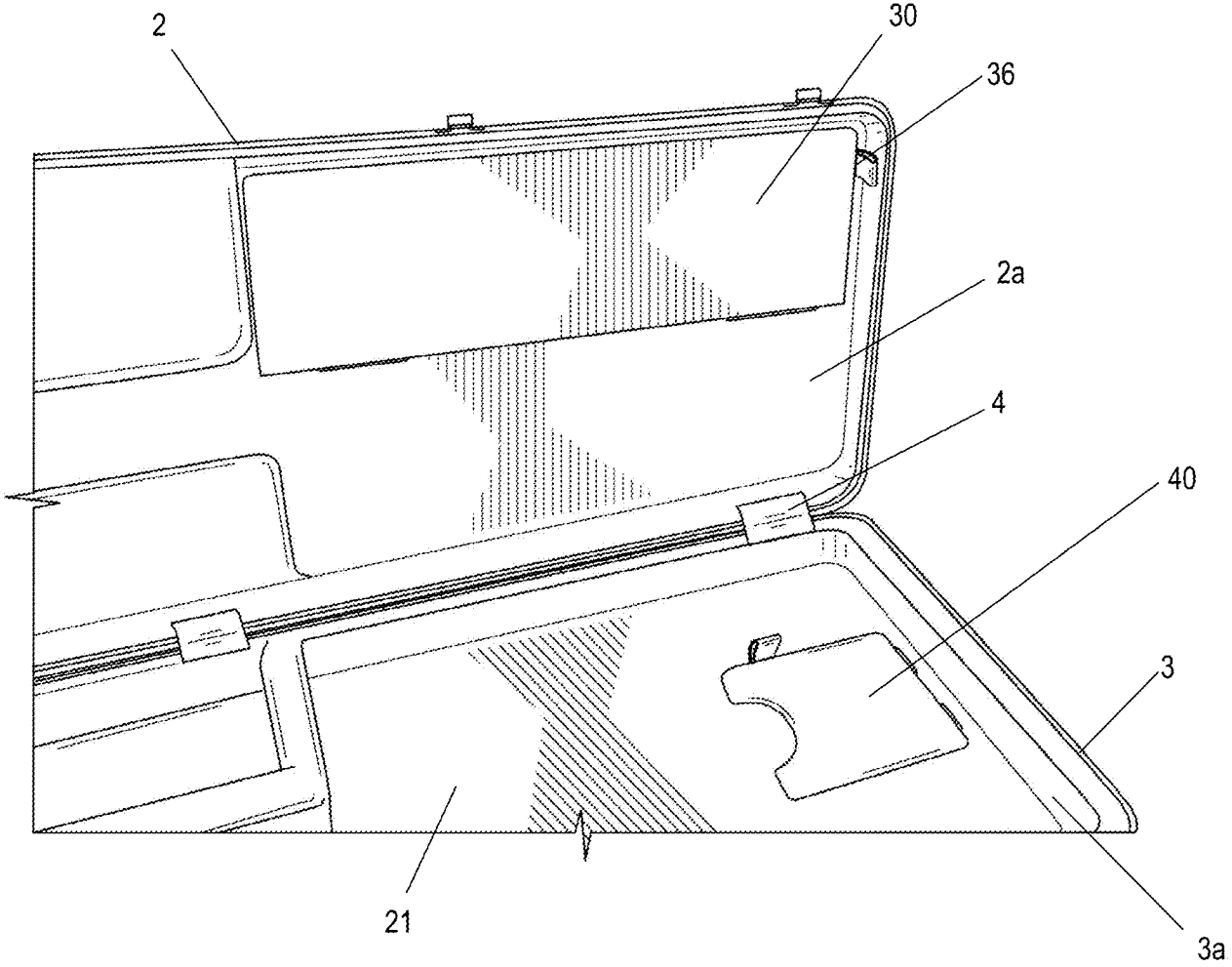
FIG. 9 shows a maintenance station in a retracted position and a shelf closed.
Figure 10:
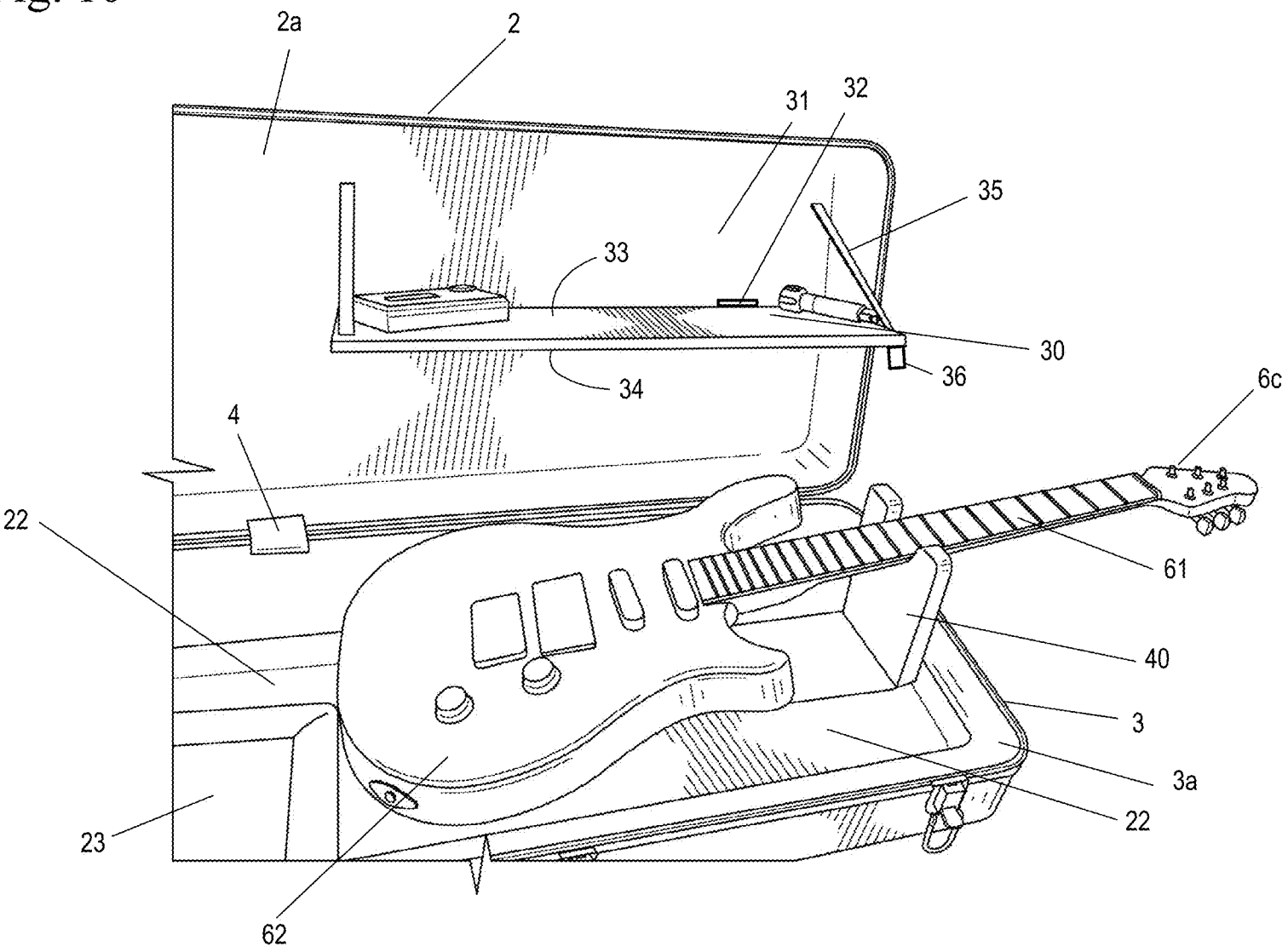
FIG. 10 shows the maintenance station in an extended position with a guitar and the shelf in an open position.
Figure 13B:
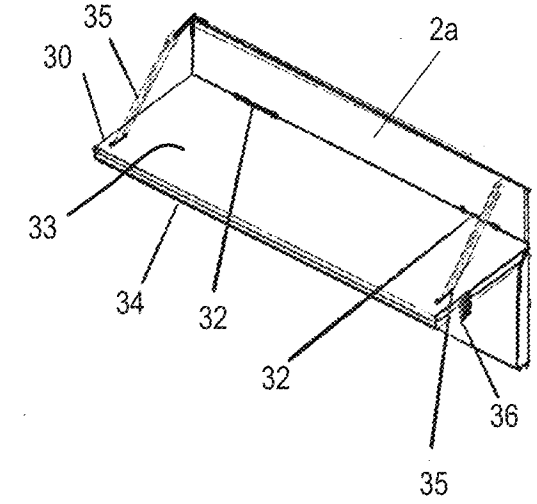
FIG. 13*b* shows a perspective view of the shelf in an open position.
Figure 13A:
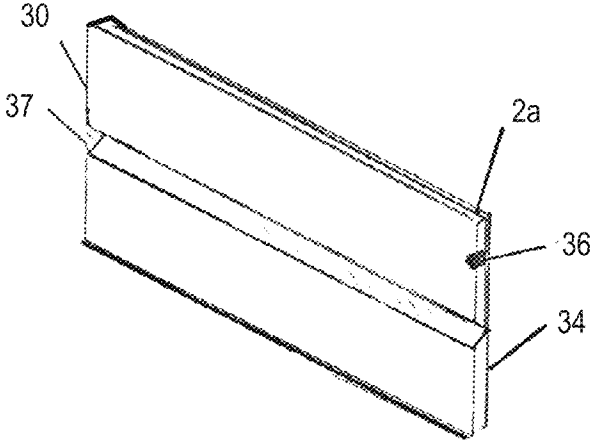
FIG. 13*a* shows a perspective view of the shelf in a closed position.

FIG. 9 shows the bottom lid 3 of the instrument case 1 with the second recessed padded area 21 with a moveable neck stand 40 of the maintenance station and the top lid 3 with the fold-out storage shelf 30. In FIG. 9, the fold-out storage shelf 30 is in a closed or recessed position and the moveable neck stand 40 is in a retracted position. FIG. 10 shows the fold-out storage shelf 30 in an open position and the moveable neck stand 40 in an extended position to receive a neck 61 of a musical instrument 6*a*-6*c*.

Referring to FIGS. 11*a*-13*b*, a portion of the top lid 2 of the padding insert 2*a* has a recess 31 cut out in order to allow the fold-out storage shelf 30 to recede into it when not deployed or in a closed position.

The fold-out storage shelf 30 is rotatably movable between a closed position and an open position through a hinge 32 attached to the top lid 2*a* of the instrument case 1. The fold-out storage shelf 30 includes a top layer 33 joined to a bottom layer 34. The bottom layer 34 of the fold-out storage shelf 30 is preferably padded and is exposed to the instrument 6*a*-6*c* present in the instrument case 1 when the fold-out storage shelf 30 and the instrument case 1 are closed and the instrument 6*a*-6*c* is in transit in the closed instrument case 1. The top layer 33 of the fold-out storage shelf 30 is preferably rigid to prevent bending of the fold-out storage shelf 30 when the fold-out storage shelf 30 is open and supporting weight and is exposed when the fold-out storage shelf 30 is in an open position. Flexible support strips 35 are attached to the top layer 33 of the fold-out storage shelf 30 to prevent the fold-out storage shelf 30 from traveling further than approximately 90 degrees relative to the top lid 2*a* of the instrument case 1 when the fold-out storage shelf 30 is in an open position. The flexible support strips 35 can include a separate hinge or hinges from hinge 32 to add additional structure and support to the fold-out storage shelf 30 in the open position. In another embodiment, the flexible support strips 35 can be replaced by a hinge. A pull tab 36 is attached to the bottom layer 34 of the fold-out storage shelf 30 to provide a tab 36 that can be pulled on to move the fold-out storage shelf 30 from a closed position to an open position. A soft foam strip 37 may be present between the padded bottom layer 34 and the top lid 2*a* of the instrument case 1 when the fold-out storage shelf 30 is closed. The foam provides a smooth, padded region to protect any instrument 6*a*-6*c* in the instrument case 1 from damage caused by the hinges 32 during transit.

In one embodiment, the fold-out storage shelf 30 is secured to the top lid 2 in the closed position by a fastener or a hinge used in place of the flexible support strips 35.

Figure 15:
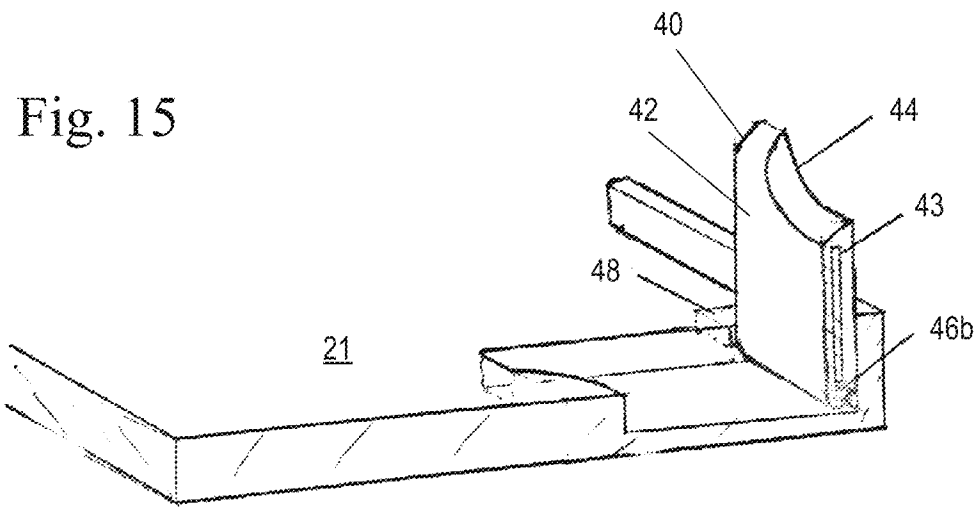
FIG. 15 shows a cut-through view of the neck rest of the maintenance station in an extended position.
Figure 14:
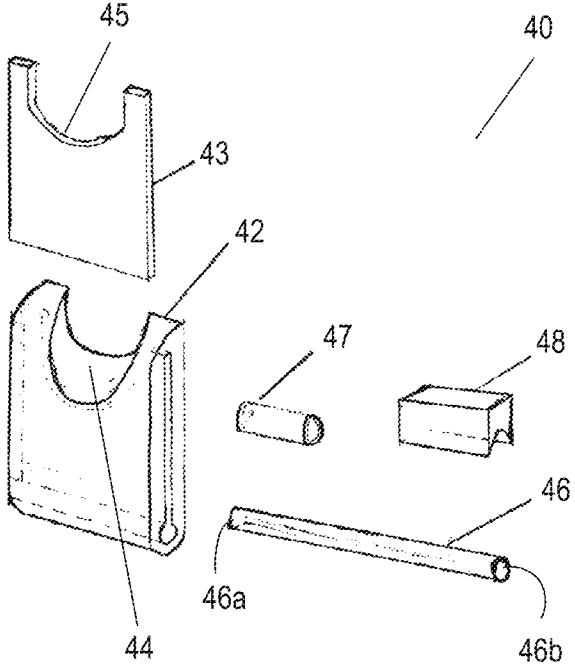
FIG. 14 shows an exploded view of the components of the neck rest of the maintenance station.
Figure 16:
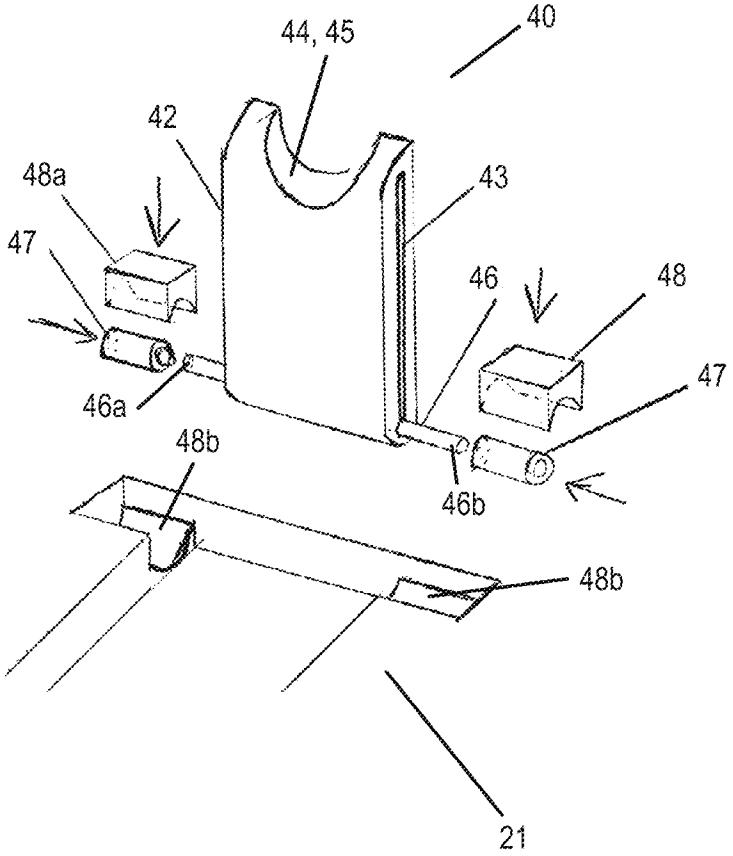
FIG. 16 shows another exploded view of the neck rest of the maintenance station.

FIGS. 14-16 show the moveable neck stand 40 of the maintenance station. The moveable neck stand 40 is moveable between a recessed position in which the neck stand 40 is flush with the second recessed padded portion 21 and an extended position to receive the neck 61 of an instrument 6*a*-6*c*. The neck stand 40 includes a foam body 42 with a center rigid core insert 43 with a C-shaped cutout 44, 45. A tab, similar to the tab attached to the fold-out storage shelf may be attached to the foam body 42. The center rigid core 43 provides stability for the deployable neck stand 40 by supporting the foam body 42 from within. The foam body 42 receives a pivot shaft 46 which passes there through and extends from either side of the foam body 42.

Pivot bushings 47 are recessed inside of the second recessed padding portion 21 of the bottom lid 3 of the instrument case 1. A pivot bushing 47 receives each end 46*a*, 46*b* of the pivot shaft 46 of the foam body 42 and allows for the pivot shaft 46 to pivot. The pivot shaft 46 is free to rotate inside of the pivot bushing 47. The pivot bushings 47 are supported by a cap 48 formed by a cap top portion 48*a* and a cap bottom portion 48*b*. The cap bottom portion 48*b* may be integrally formed with the second recessed padding portion 21. The cap top and bottom portions 48*a*, 48*b* of the cap 48 covers the pivot bushings 47 and helps secure the pivot bushings 47 in place, while allowing for a smooth surface on the top of the second recessed padding portion 21.

Figure 20B:
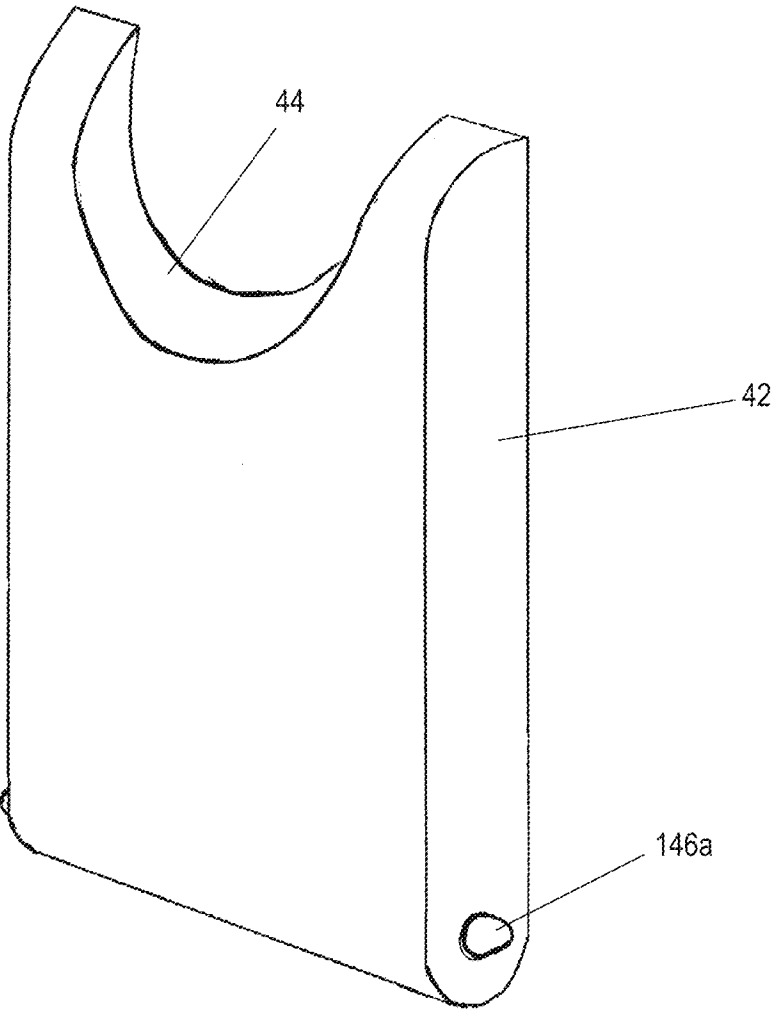
FIG. 20*b* shows the body of the neck stand of the embodiment of FIG. 20*a*.
Figure 20A:
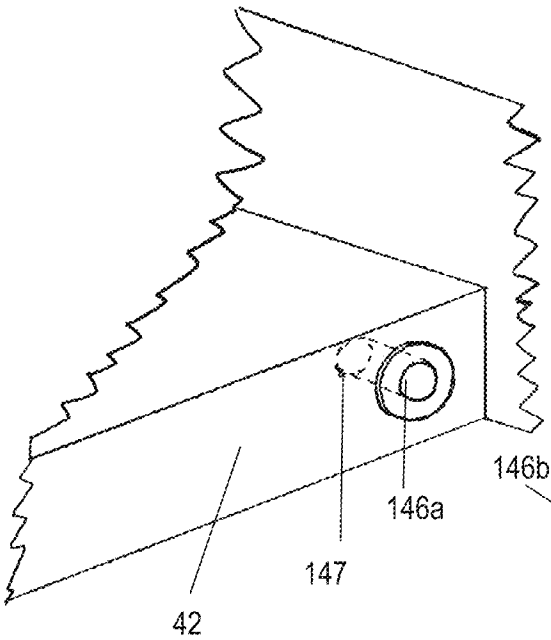
FIG. 20*a* shows a cut away of the neck stand of an alternate embodiment.
Figure 21:
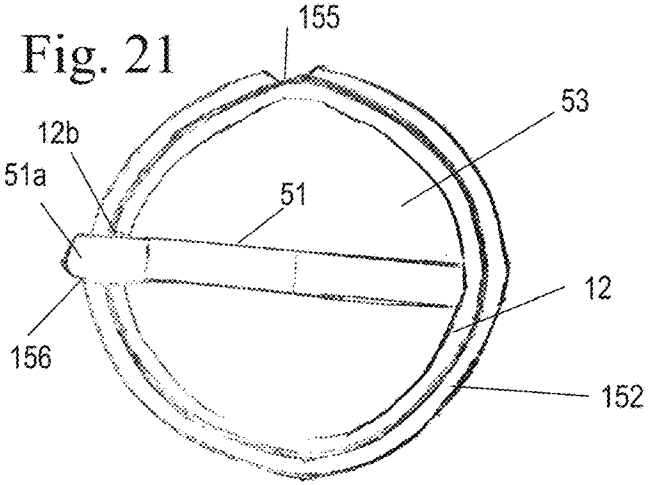
FIG. 21 shows a cut-through view of an example of an alternate locking mechanism to lock a guitar stand in an extended position and a recessed position.
Figure 22:
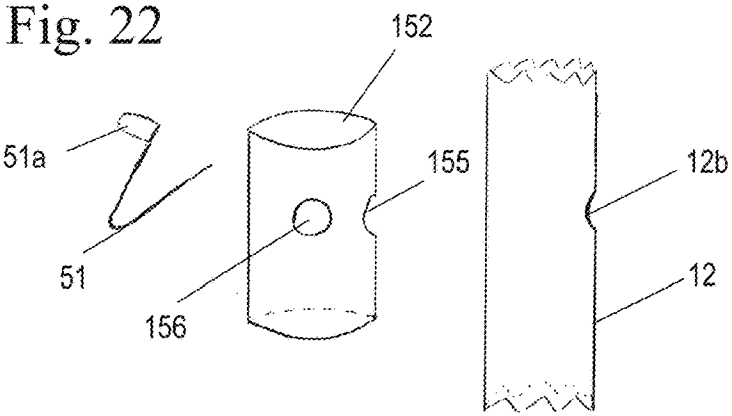
FIG. 22 shows components of the locking mechanism of FIG. 21.
Figure 24:
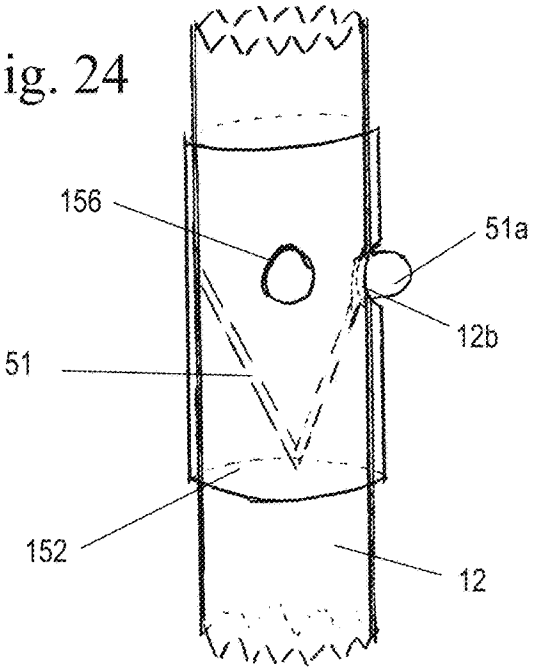
FIG. 24 shows another view of the locking mechanism of FIG. 21.
Figure 23:
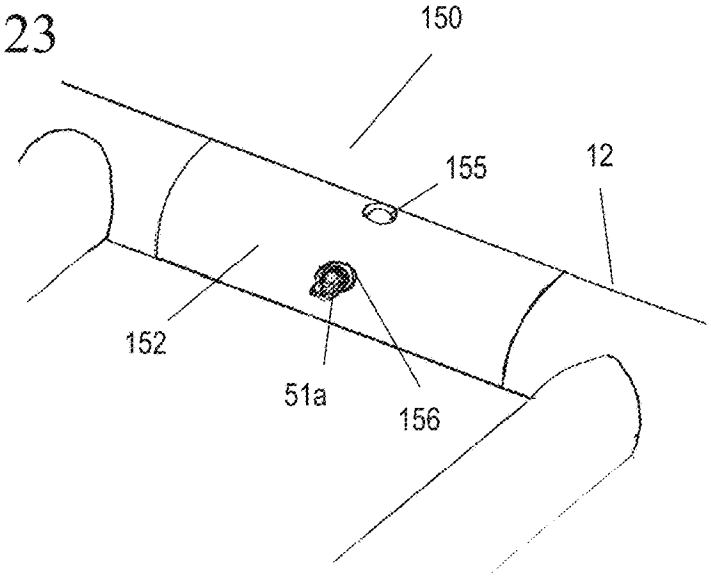
FIG. 23 shows a close-up of the locking mechanism of FIG. 21.

In an alternate embodiment as shown in FIGS. 20*a*-20*b*, push pins 146*a*, 146*b* which each extend a length, are received within bores 147 on either side of the body 42 and would replace pivot shaft 46 of the previous embodiment. The push pins 146*a*, 146*b* are received by the pivot bushings 47 and could be inserted without using a cap 48.

Figure 17:
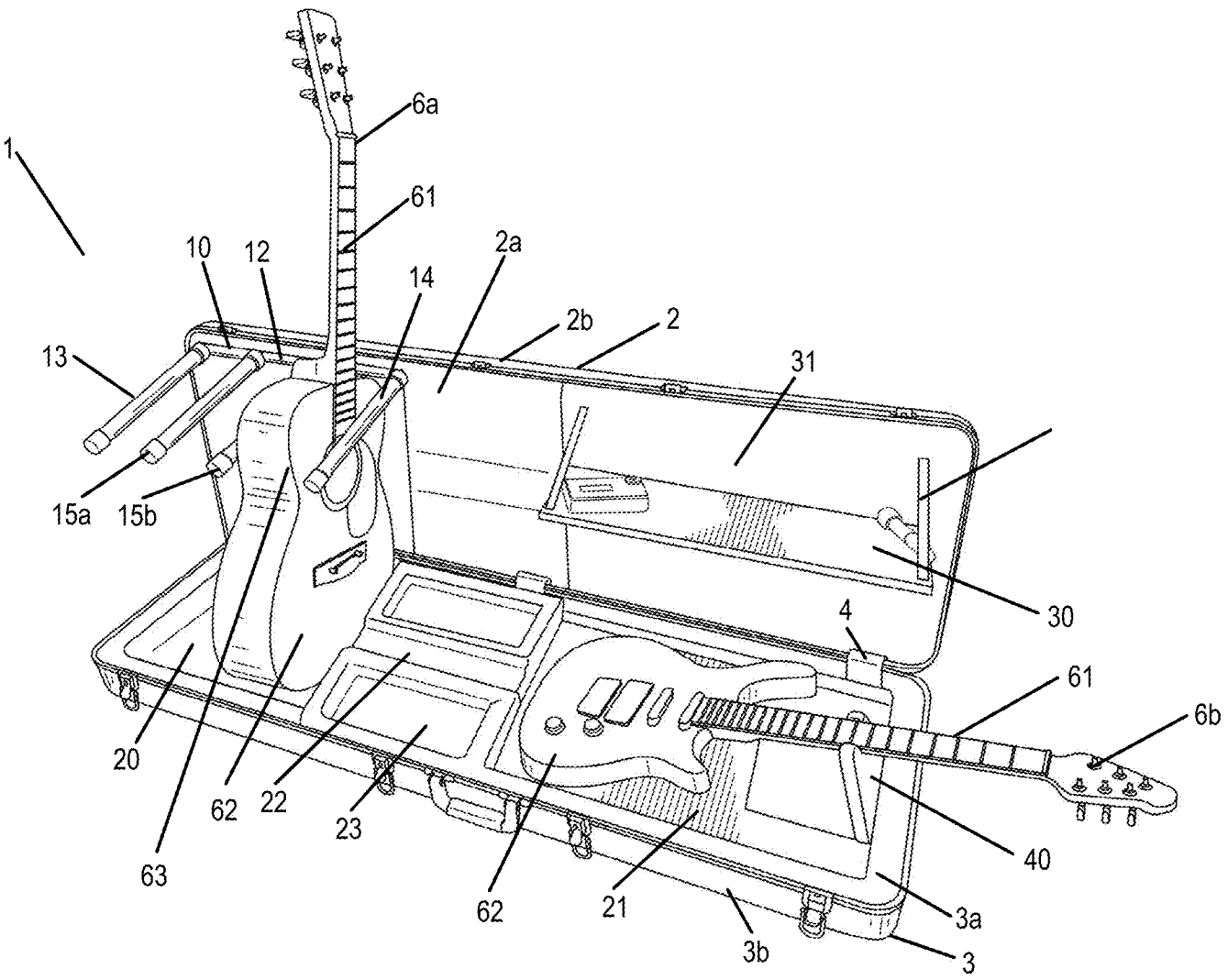
FIG. 17 shows the instrument case of an embodiment of the present invention in an open position with a guitar in a standing position and a bass in the maintenance station.

FIG. 17 shows the rack instrument stand 10, the moveable neck stand 40, and the fold-out storage shelf 30 in open, extended positions. After the instrument case 1 is opened, to use the rack instrument stand 10, a user rotates the rack instrument stand 10 such that the extension pieces 13-15*b* are perpendicular to the bottom lid 3 of the instrument case 1. The rack instrument stand 10 is preferably locked in place using the locking mechanism 50, such that the push button 51*a* is present within the holes 55, 12*b* of the pivot sleeve 52 and the back framework piece 12.

An instrument 6*a*-6*c* is then inserted between extension pieces 13-15*b* in an upright manner such that a body 62 or waist 63 of the instrument is received between extension pieces 13-15*b* and the neck 61 of the instrument 6*a*-6*c* is perpendicular to the bottom lid 3 of the instrument case 1. If desired, removable spacers 24 be placed in the first recessed portion 20 of the bottom lid 3 of the instrument case 1 to steady and separate the bodies 62 of the instruments 6*a*-6*c*.

To use the maintenance station portion of the instrument case 1, the moveable neck stand 40 is rotated to the extended position and an instrument 6*a*-6*c* is placed such that the bottom of the body 62 of the instrument 6*a*-6*c* abuts the foam padded body 42 of the neck stand 40 and rests within the second recessed padded area 21 and the neck 61 of the instrument is received by the C-cut 44, 45 of the moveable neck stand 40. In this position, the instrument 6*a*-6*c* is in at angle within a range of 0-45 degrees relative to the bottom lid 3 of the instrument case 1, allowing for maintenance to be performed easily on the instrument 6*a*-6*c*. At this time, the user can open the fold-out storage shelf 30 by pulling the pull tab 42 and the fold-out storage shelf 30 rotating from a recessed position to an open position.

Figure 19:
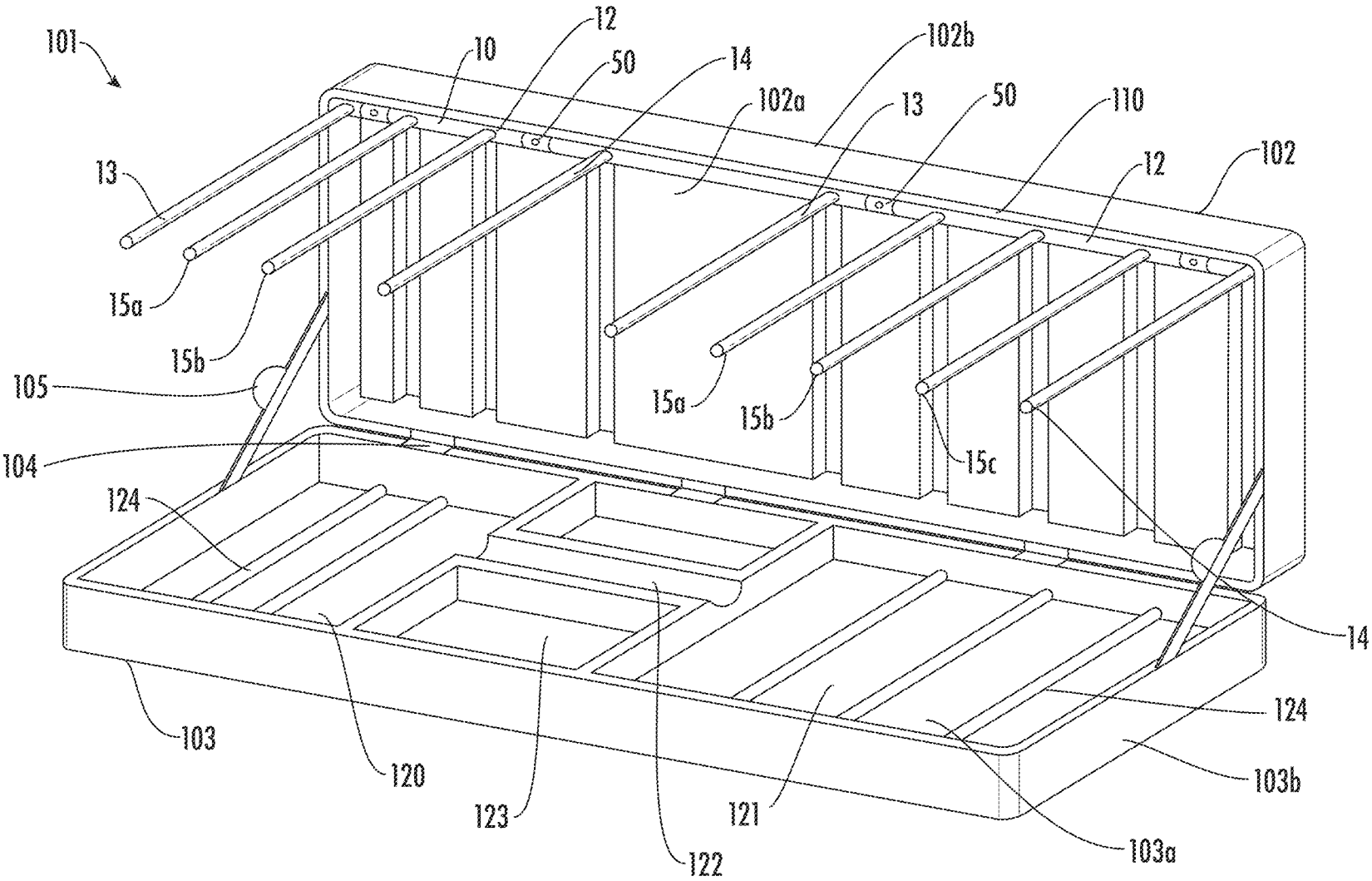
FIG. 19 shows an instrument case of an alternate embodiment with room to accommodate multiple guitars and basses in a standing position.

FIG. 19 shows another embodiment of the instrument case 101, containing two rack instrument stands 10, 110, rather than the one instrument stand 10 with a maintenance station as shown in FIGS. 1-18. As shown in FIG. 19, the second rack instrument stand replaces the fold-out storage shelf of the previous embodiment and the moveable neck stand of the previous embodiment has been removed.

The instrument case 101 includes a top lid 102 and a bottom lid 103. The top lid 102 and the bottom lid 103 of the instrument case 101 each include a padding insert 102*a*, 103*a* surrounded by a hard outer shell 102*b*, 103*b*. The padding insert 102*a*, 103*a* may include a fabric covering to provide additional protection to the instrument housed within the instrument case 101. The top lid 102*a* is connected to the bottom lid 103*a* through a series of a hinges 104 or other connectors to allow the top lid 102 to rotate between at least an open position that is 90 degrees relative to the bottom lid 103 and a closed position and other positions in between. When the instrument case 101 is in a closed position and the top lid 102 is secured to the bottom lid 103, the instrument case 101 is used to transport an instrument and the top and bottom halves 102, 103 surround the instrument within the instrument case between the padding inserts 102*a*, 103*a*.

An additional lock or mechanism 105 can be present connecting the top lid 102 to the bottom lid 103 and locking the top lid 102 in a position of 90 degrees relative to the bottom lid 103. It should be noted that in an embodiment of the present invention, the top lid 102 can be locked into other position relative to the bottom lid 103 that are less than 90 degrees.

The top lid 102 includes padding insert 102*a* to protect an instrument 6 during transport within the instrument case 101. Additionally, the top lid 102 includes a first rack instrument stand 10 and a second rack instrument stand 110 which are each independently moveable between an extended position and a retracted position. In the extended position, the first and second rack instrument stands 10, 110 are parallel to the bottom lid 103 and is perpendicular to the top lid 102. In the retracted position, the first rack instrument stands 10, is received within a first area 170 of the padding insert 102*a* of the top lid 102 and the second rack instrument stand 110 is received within the second area 172 of the padding insert 102*a* of the top lid 102 and the and preferably does not contact an instrument 6 which is placed in the bottom lid 103 when the instrument case 101 is closed for transport of the instrument.

The bottom lid 103 of the instrument case 101 includes a padding insert 103*a* which includes a first recessed padded area 120, a second recessed padded area 121, and a padded neck support 122 between the first and second recessed padded areas 120, 121. The padded neck support 122 can additionally include compartments 123 for storage.

When the top lid 102 is rotated about the hinges 104 to a position 90 degrees relative to the bottom lid 103, the first rack instrument stand 10 is aligned with the first recessed padded area 120 and the second rack instrument stand 110 is aligned with the second recessed padded area 121.

Each rack instrument stand 10, 110 has a framework 11 which is essentially "comb" shaped. The rack instrument stand 10, 110 has a hollow back framework piece 12 with a first end extension piece 13, a second end extension piece 14 and at least one middle extension piece 15*a*, 15*b*, 15*c* spaced a distance D1, D2 from the end extension pieces 13, 14 and any other middle extension pieces 15*a*, 15*b*, 15*c*. The distance D1, D2 can vary to accommodate different sized instruments. The back framework piece 12 is secured 17 to the top lid 102 of the instrument case 101, but is rotatable between the retracted position and the extended position.

In the extended position, the extension pieces 13, 14, 15*a*, 15*b* of the first guitar rack stand 10 extend and are parallel to the first recessed padded area 20 of the bottom lid 3 of the instrument case 1 and the extension pieces 13, 14, 15*a*, 15*b*, 15*c* of the second guitar rack stand 110 extend and are parallel to the second recessed padded area 120 of the bottom lid 103 of the instrument case 101. In one embodiment, the first recessed padded area 120 and the second recessed padded area 21 each include detachable padded spacers 124 to aid in separating and maintaining the instruments between the extension pieces 13, 14, 15*a*, 15*b*, 15*c* of the first and second rack instrument stands 10, 110. Alternatively, the spaces 124 can be present and used for one of the rack instrument stands 10, 110 It should be noted that the configuration of the spacers 124 is not limited to the configuration shown in the drawings. During transport of the instrument with the instrument case in a closed position, the spacers 124 can be removed and stored elsewhere within the instrument case 101.

The back framework piece 12 of the first and second rack instrument stands 10, 110 can include a locking mechanism 50, which secures the back framework piece 12 into the extended position as described above. Each of the extension pieces 13, 14, 15*a*, 15*b*, 15*c* of each of the rack instrument stands 10, 110 can include padding or cushioning to aid preventing any damage occurring to the necks 61 or the body 62 of the instruments 6*a*-6*c* when placed in the rack instrument stands 10, 110.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An instrument case comprising:

a top lid comprising a padded insert surrounded by an outer shell;

a bottom lid rotatably secured to the top lid, the bottom lid comprising a padded insert having a first recessed area, a second recessed area and a neck rest between the first recessed area and the second recessed area, the padded insert being surrounded by an outer shell, the top lid and the bottom lid being movable between an open position and a closed position;

a rack instrument stand secured to the top lid and moveable between an extended position and a retracted position, the rack instrument stand comprising a comb-shaped framework having a back framework piece connected to a first end extension piece, a second end extension piece and at least one middle extension piece between the first end extension piece and the second end extension piece, wherein when the rack instrument stand is in the extended position, the first end extension piece, the second end extension piece and the at least one middle extension piece are parallel to the padded insert of the bottom lid and when the rack instrument stand is in the retracted position, the first end extension piece, the second end extension piece and the at least one middle extension piece are perpendicular to the padded insert of the bottom lid and received within the padded insert of the top lid; and a maintenance station comprising a neck rest comprising a body defining a C-shaped cutout and receiving a pivot shaft rotatably secured to the second recessed area of the bottom lid, the neck rest moveable between an extended, upright position and a retracted position.

2. The instrument case of claim 1, wherein the rack instrument stand further comprises a lock mechanism having an unlocked position and a locked position in which the rack instrument stand is locked in at least the extended position, the lock mechanism comprising a pivot sleeve having a hole surrounding a portion of the back framework piece having a hole, and a metal spring clip having a push button received within a hollow portion of the back framework piece biasing the push button through the hole of the back framework piece and the hole of the pivot sleeve, wherein in the locked position the push button of the metal spring clip is received within the hole of the back framework piece and the hole of the pivot sleeve and wherein in the unlocked position, the push button of the metal spring clip is received within the hole of the back framework piece.

3. The instrument case of claim 1, further comprising at least one removable spacer placed within the first recessed area to maintain separation between instruments received by the rack instrument stand.

4. The instrument case of claim 1, wherein the padded insert of the bottom lid further comprises a plurality of compartments between the first recessed area and the second recessed area.

5. The instrument case of claim 1, wherein the body of the neck rest further comprises a rigid core.

6. The instrument case of claim 1, wherein the pivot shaft of the moveable neck rest is rotatably secured to the second recessed area of the bottom lid through bushings and a two piece cap.

7. The instrument case of claim 1, wherein the padded insert of the top lid further comprises a fold-out storage shelf rotatably secured to the padded insert, the fold-out storage shelf being moveable between an open position and a closed position.

8. The instrument case of claim 1, wherein the rack instrument stand and the maintenance station can accommodate guitars, bass guitars and acoustic guitars.

9. The instrument case of claim 1, wherein the rack instrument stand further comprises a lock mechanism having an unlocked position and a locked position in which the rack instrument stand is locked in the extended position and the retracted position, the lock mechanism comprising a pivot sleeve having a first hole and a second hole, the pivot sleeve surrounding a portion of the back framework piece having a hole, and a metal spring clip having a push button received within a hollow portion of the back framework piece biasing the push button through the hole of the back framework piece and into either the first hole or the second hole of the pivot sleeve, wherein in the locked position the push button of the metal spring clip is received within the hole of the back framework piece and the hole of the pivot sleeve and wherein in the unlocked position, the push button of the metal spring clip is received within the hole of the back framework piece.

10. The instrument case of claim 1, wherein the back framework piece of the rack instrument stand further comprises:

a first hollow end having at least a first hollow end hole;

a second hollow end having at least a second hollow end hole, the second hollow end hole being misaligned from the first hollow end hole;

a first end cap received with the first hollow end comprising a spring biased pin and a first end cap retaining pin secured to the top lid; and a second end cap received with the second hollow end comprising a spring biased pin and a second end cap retaining pin secured to the top lid;

wherein when the first end cap retaining pin is aligned with the at least first hollow end hole, the first end cap retaining pin is spring biased to project through the first hollow end hole maintaining the back framework piece in a first position; and wherein when the second end cap retaining pin is aligned with the at least second hollow end hole, the second end cap retaining pin is spring biased to project through the second hollow end hole maintaining the back framework piece in a second position, different than the first position.

11. The instrument case of claim 10, wherein the back framework piece is a hollow tube having a circumference and the first hollow end hole and the second hollow end hole are spaced at least 90 degrees apart along the circumference of the back framework piece.

12. An instrument case comprising:

a top lid comprising a padded insert surrounded by an outer shell;

a bottom lid rotatably secured to the top lid, the bottom lid comprising a padded insert having a first recessed area, a second recessed area and neck rest between the first recessed area and the second recessed area, the padded insert surrounded by an outer shell, the top lid and the bottom lid being movable between an open position and a closed position;

a first rack instrument stand secured to the top lid, aligned with the first recessed area, and moveable between an extended position and a retracted position, the first rack instrument stand comprising a comb-shaped framework having a back framework piece connected to a first end extension piece, a second end extension piece and at least one middle extension piece between the first end extension piece and the second end extension piece, wherein when the first rack instrument stand is in the extended position, the first end extension piece, the second end extension piece and the at least one middle extension piece are parallel to the first recessed area of the bottom lid and when the first rack instrument stand is in the retracted position, the first end extension piece, the second end extension piece and the at least one middle extension piece are perpendicular to the padded insert of the bottom lid and received within the padded insert of the top lid; and a second rack instrument stand secured to the top lid, aligned with the second recessed area and moveable between an extended position and a retracted position, the second rack instrument stand comprising a comb-shaped framework having a back framework piece connected to first end extension piece, a second end extension piece and at least one middle extension pieces between the first end extension piece and the second end extension piece, wherein when the second rack instrument stand is in the extended position, the first end extension piece, the second end extension piece and the at least one middle extension piece are parallel to the second recessed area of the bottom lid and when the second rack instrument stand is in the retracted position, the first end extension piece, the second end extension piece and the at least one middle extension piece are perpendicular to the padded insert of the bottom lid and received within the padded insert of the top lid.

13. The instrument case of claim 12, wherein the first rack instrument stand and the second rack instrument stand each further comprising a lock mechanism having a locked position locking the first rack instrument stand or the second rack instrument stand in at least the extended position and an unlocked position, the lock mechanism comprising a pivot sleeve having a hole surrounding a portion of the back framework piece having a hole, and a metal spring clip having a push button received within a hollow portion of the back framework piece biasing the push button through the hole of the back framework piece and the hole of the pivot sleeve, wherein in the locked position the push button of the metal spring clip is received within the hole of the back framework piece and the hole of the pivot sleeve and wherein in the unlocked position, the push button of the metal spring clip is received within the hole of the back framework piece.

14. The instrument case of claim 12, further comprising removable spacers placed within the first recessed area and/or the second recessed area to maintain separation between instruments received by the first rack instrument stand and/or the second rack instrument stand.

15. The instrument case of claim 12, wherein the padded insert of the bottom lid further comprises a plurality of compartments between the first recessed area and the second recessed area.

16. The instrument case of claim 12, wherein the first rack instrument stand accommodates up to six instruments selected from the group consisting of guitars, bass guitars and acoustic guitars.

17. The instrument case of claim 12, wherein the second rack instrument stand accommodates up to eight instruments selected from the group consisting of guitars, bass guitars and acoustic guitars.

18. The instrument case of claim 12, wherein the first rack instrument stand and the second rack instrument stand each further comprises a lock mechanism having an unlocked position and a locked position in which the rack instrument stand is locked in at least the extended position, the lock mechanism comprising a pivot sleeve having a hole surrounding a portion of the back framework piece having a hole, and a metal spring clip having a push button received within a hollow portion of the back framework piece biasing the push button through the hole of the back framework piece and the hole of the pivot sleeve, wherein in the locked position the push button of the metal spring clip is received within the hole of the back framework piece and the hole of the pivot sleeve and wherein in the unlocked position, the push button of the metal spring clip is received within the hole of the back framework piece.

19. The instrument case of claim 12, wherein the back framework piece of the first rack instrument stand and the second rack instrument stand each further comprises:

a first hollow end having at least a first hollow end hole;

a second hollow end having at least a second hollow end hole, the second hollow end hole being misaligned from the first hollow end hole;

a first end cap received with the first hollow end comprising a spring biased pin and a first end cap retaining pin secured to the top lid; and a second end cap received with the second hollow end comprising a spring biased pin and a second end cap retaining pin secured to the top lid;

wherein when the first end cap retaining pin is aligned with the at least first hollow end hole, the first end cap retaining pin is spring biased to project through the first hollow end hole maintaining the back framework piece in a first position; and wherein when the second end cap retaining pin is aligned with the at least second hollow end hole, the second end cap retaining pin is spring biased to project through the second hollow end hole maintaining the back framework piece in a second position, different than the first position.

20. The instrument case of claim 19, wherein the back framework piece is a hollow tube having a circumference and the first hollow end hole and the second hollow end hole are spaced at least 90 degrees apart along the circumference of the back framework piece.

* * * * *